US007604427B2

(12) United States Patent
Taniguchi

(10) Patent No.: US 7,604,427 B2
(45) Date of Patent: Oct. 20, 2009

(54) PRESSURIZED PEN

(75) Inventor: Shunichi Taniguchi, Kanagawa (JP)

(73) Assignee: Tombow Pencil Co., Ltd., Tokyo (JP)

( * ) Notice: Subject to any disclaimer, the term of this patent is extended or adjusted under 35 U.S.C. 154(b) by 354 days.

(21) Appl. No.: 11/820,874

(22) Filed: Jun. 21, 2007

(65) Prior Publication Data

US 2008/0019761 A1 Jan. 24, 2008

(30) Foreign Application Priority Data

Jul. 18, 2006 (JP) ..... 2006-196193

(51) Int. Cl.
*B43K 5/18* (2006.01)
*B43K 5/02* (2006.01)

(52) U.S. Cl. ..... 401/188 A; 401/101; 401/188 R; 401/187; 401/143

(58) Field of Classification Search ..... 401/187, 401/188 R, 188 A, 101
See application file for complete search history.

(56) References Cited

U.S. PATENT DOCUMENTS

| | | | | |
|---|---|---|---|---|
| 2,560,810 | A | 7/1951 | Morris | |
| 2,787,249 | A | 4/1957 | Barlow et al. | |
| 3,415,603 | A * | 12/1968 | Blanchard | 401/188 A |
| 6,729,787 | B2 * | 5/2004 | Usami et al. | 401/219 |
| 7,128,491 | B2 * | 10/2006 | Kobayashi | 401/188 A |
| 7,226,231 | B2 * | 6/2007 | Py et al. | 401/155 |
| 7,303,349 | B2 * | 12/2007 | Murakoshi | 401/188 A |

FOREIGN PATENT DOCUMENTS

| | | |
|---|---|---|
| JP | 2004 175083 A | 6/2004 |
| JP | 2004 209898 A | 7/2004 |
| JP | 2005 028694 A | 2/2005 |
| JP | 2005 066961 A | 3/2005 |
| JP | 2005 280119 A | 10/2005 |

OTHER PUBLICATIONS

European Search Report dated Nov. 28, 2007.
European Search Report dated Nov. 16, 2007.

* cited by examiner

*Primary Examiner*—David J. Walczak
*Assistant Examiner*—Keegan Gumbs
(74) *Attorney, Agent, or Firm*—Scott D. Wofsy; Edwards Angell Palmer & Dodge LLP

(57) ABSTRACT

A pressurized pen having excellent feeling of using it by allowing an easy knocking operation with small force is disclosed. The pressurizing member 18 includes an elastic cylindrical member 19. The elastic cylindrical member 19 has a large-diameter front cylinder portion of which a front end 20*a* in air-tight manner communicates directly with the rear opening portion 6*b* of an ink containing tube 6 and which forms the pressurizing chamber 22, and a small-diameter rear cylinder portion 21 which is coaxially connected to a rear end of the front cylinder portion 20 and in which the front end portion 17*a* of the pressing member 17 is pressed into a rear aperture 21*a* thereof. The inside of the ink containing tube 6 is pressurized by allowing the pressing member 17 to press the rear cylinder portion 21 into the front cylinder portion 20 and compressing the elastic cylindrical member 19 in the axial direction with the pressing chamber 22 air-tight.

3 Claims, 8 Drawing Sheets

PRESSURIZED PEN

BACKGROUND OF THE INVENTION

1. Field of the Invention

The present invention relates to a pen such as a ball-point pen, a correction pen, or a glue pen, and more particularly to a pressurized pen enabling smooth supply of medium such as ink, correction fluid, or glue at the time of using the pen.

2. Description of the Related Art

Conventional pens such as ball-point pens have the disadvantage in that a pen tip must be rubbed several times on a paper whenever the ink doesn't smoothly come out of a pen tip of a pen refill unit at the time of using the pen, or the ink is exhausted in the course of writing down on notes.

In this regard, as disclosed in the JP 2005-280119 A, a knock-type ball-point pen is known, in which a press pump mechanism formed of a cylinder and a piston is disposed in a pen refill unit of the pen, a loop-shaped elastic ring made for example of rubber is disposed on a front end portion of the piston that is in sliding contact with an inner peripheral surface of the cylinder, and the press pump mechanism is interlocked with a knock mechanism, a compression chamber in the cylinder is compressed by a knocking operation of the piston at the time of using the pen, and an inside of an ink containing tube filled with ink is pressurized.

In the knock-type pen disclosed in above mentioned publication, the outer peripheral surface of the loop-shaped elastic ring in the front end portion of the piston is brought in close contact with the inner peripheral surface of the cylinder and thus isolated from the outside air, and the piston is moved frontward in cooperation with the knock mechanism at the time of using the pen, whereby air in the compression chamber within the cylinder is pressurized. However, when fabricating the loop-shaped elastic ring, outer diameter precision of the loop-shaped elastic ring may be lowered by irregularities of the outer diameter or burrs caused by joint lines of a mold, and thus the case where the sealing ability is not sufficient occasionally occurs.

To increase the sealing ability by minimizing deformation of the loop-shaped elastic ring, it is necessary to employ a large design value of the outer diameter of the loop-shaped elastic ring.

Meanwhile, when the large design value of the outer diameter of the loop-shaped elastic ring is employed, it is required to use a spring having a high elastic coefficient in order to decompress the piston to its original position of the rear.

Then, conversely, there is a problem of deteriorating the feeling of using the pen since the large force is needed to perform the knocking operation at the time of using the pen.

SUMMARY OF THE INVENTION

The invention has been made in consideration of the above-mentioned disadvantages involved with prior pens. Accordingly it is an object of the invention to provide an improved pressurized pen. Another object of the invention is to provide a pressurized pen having excellent feeling of using it by allowing an easy knocking operation with small force.

In accordance with the invention these and other objects are obtained by a pressurized pen in which a pen refill unit is loaded in a barrel, a pen tip is disposed on a front end portion of a medium containing tube for containing ink and the like in the pen refill unit, a press pump mechanism presses an inside of a rear opening portion of the medium containing tube, and a knock mechanism disposed on a rear end section of the barrel enables the pen tip to protrude and retreat from the front end section of the barrel. The press pump mechanism includes a pressurizing member which has a pressurizing chamber communicating with the inside of the medium containing tube and which is disposed on the rear opening portion of the medium containing tube so as to freely expand and contract in an axial direction, and a pressing member which is configured to press the pressurizing member in a pressing direction and which interlocks with a pressing operation of the knock mechanism. The pressurizing member includes an elastic cylindrical member, and the elastic cylindrical member includes a large-diameter front cylinder portion of which a front end air-tightly communicates directly with the rear opening portion of the medium containing tube and which forms the pressurizing chamber, and a small-diameter rear cylinder portion which is coaxially connected to a rear end of the front cylinder portion and in which the front end portion of the pressing member is pressed into a rear aperture thereof, the inside of the medium containing tube is pressurized by allowing the pressing member to press the rear cylinder portion into the front cylinder portion and compressing the elastic cylindrical member in the axial direction with the pressing chamber air-tight, and wherein the elastic cylindrical member is decompressed so as to elongate in the axial direction and the inside of the medium containing tube communicates with the outside air, by a pressing and opening operation of the pressing member.

According to an embodiment of the invention the pressing member follows a rotor driven through a cam mechanism by the pressing and opening operation of a knock bar in the knock mechanism, and the elastic cylindrical member is compressed to pressurize the inside of the medium containing tube, and the pen tip is made to protrude from the front end portion of the barrel by the pressing operation of the knock bar.

According to another embodiment of the invention the elastic cylindrical member maintains a compressed state with the pen tip protruding, and the elastic cylindrical member maintains an elongated state where the elastic cylindrical member is capable of communicating with the outside air with the pen tip retreating.

The following advantages are obtained by the invention.

A compressive deformation is caused by a pressurizing member of a press pump mechanism configured so as to freely expand and contract in an axial direction, and a pressing member configured so as to interlock with a pressing operation of the knock mechanism. Therefore, since the system configured to pressurize an inside of the medium containing tube is possible to easily compress and deform the pressurizing member, it is possible to obtain a pressurized pen having excellent feeling of using the pen by allowing an easy knocking operation with small force.

The pressurizing member includes an elastic cylindrical member, and the elastic cylindrical member includes a large-diameter front cylinder portion of which a front end air-tightly communicates directly with the rear opening portion of the medium containing tube and which forms the pressurizing chamber, and a small-diameter rear cylinder portion which is coaxially connected to a rear end of the front cylinder portion and in which the front end portion of the pressing member is pressed into a rear aperture thereof. By allowing the pressing member to press the rear cylinder portion into the front cylinder portion, the pressurizing chamber is formed to be an airtight state, and thus it is possible to easily compress and deform the pressurizing member.

According to the embodiment of invention, the pressing member follows a rotor in the knock mechanism, and the elastic cylindrical member is compressed to pressurize the inside of the medium containing tube, and the pen tip is made to protrude from the front end portion of the barrel by the pressing operation of the knock bar. Therefore, it is possible to easily pressurize in the medium containing tube.

According to other embodiment of the invention the inside of the medium containing tube can maintain a pressurized state when using the pen, therefore it is effective in preventing the rack of ink particularly when the pen tip is used in an upward state.

The accompanying drawings which are incorporated in and constitute part of the present specification, are included to illustrate and provide for a further understanding of the invention.

DESCRIPTION OF PREFERRED EMBODIMENTS

Hereinafter, the invention will be described in detail with reference to embodiments thereof showing a knock-type ball-point pen as an example and the drawings.

Figure 1:
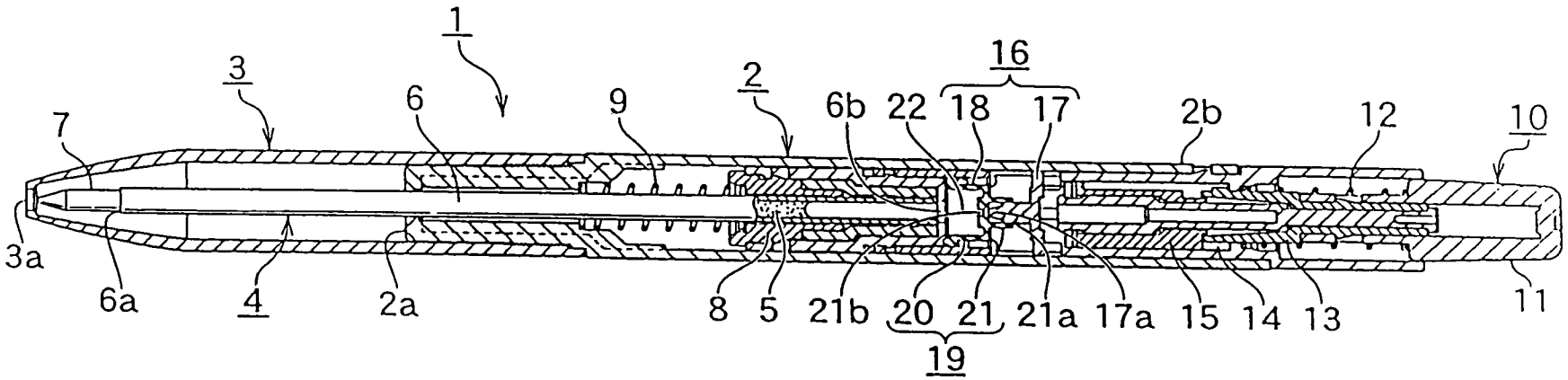
FIG. 1 is a sectional view of a knock-type ball-point pen in a non-pressurized state according to an embodiment of the invention.

In FIG. 1, "left side" is defined as "the front", and "right side" is defined as "the rear" of the pen.

As shown in the FIG. 1, in a ball-point pen 1 of the invention, the pen holder is formed of a barrel 2 and a front member 3 screwed onto a front end section 2*a* of the barrel 2, and a pen refill unit 4 is loaded in the pen holder.

The pen refill unit 4 includes an ink containing tube 6 filled with ink 5 as a medium for writing, a pen tip 7 loaded on a front end portion 6*a* of the ink containing tube 6. The pen tip 7 is configured to protrude and retreat from the front aperture section 3*a* of the front member 3 to the outside by operating the pen refill unit 4 which will be mentioned later.

A rear opening portion 6*b* of the ink containing tube 6 is kept and held by a holder 8 which is a member sliding in front and rear axial direction in the barrel 2. The holder 8 is biased toward the rear so that the pen tip 7 of the pen refill unit 4 by a compression spring 9 is contained in an inside of the front member 3.

A knock mechanism 10 is assembled into an inside of a rear end section 2*b* of barrel 2. The knock mechanism 10 includes a knock section 11, a compression spring 12 biased to the rear so as to protrude the knock section 11 from the rear end section 2*b* of the barrel 2, a knock bar 13 cooperating with the pressing operation of the knock section 11 which resists against a bias force of the compression spring 12 and the opening operation thereof, a cam mechanism portion 14 interlocking with the knock bar 13, and a rotor 15 cooperating with the cam mechanism portion 14. In that case, the spring force of the compression spring 12 is set to be smaller than the spring force of the compression spring 9.

That is, the knock mechanism 10 is a known mechanism which presses and opens the knock bar 13 against the bias force of the compression spring 12 by the knocking operation of the knock section 11, and thus driving the rotor 15 by the cam mechanism portion 14, so as to spear and disappear the pen tip 7 of the pen refill unit 4 in a protruded state.

Figure 2:
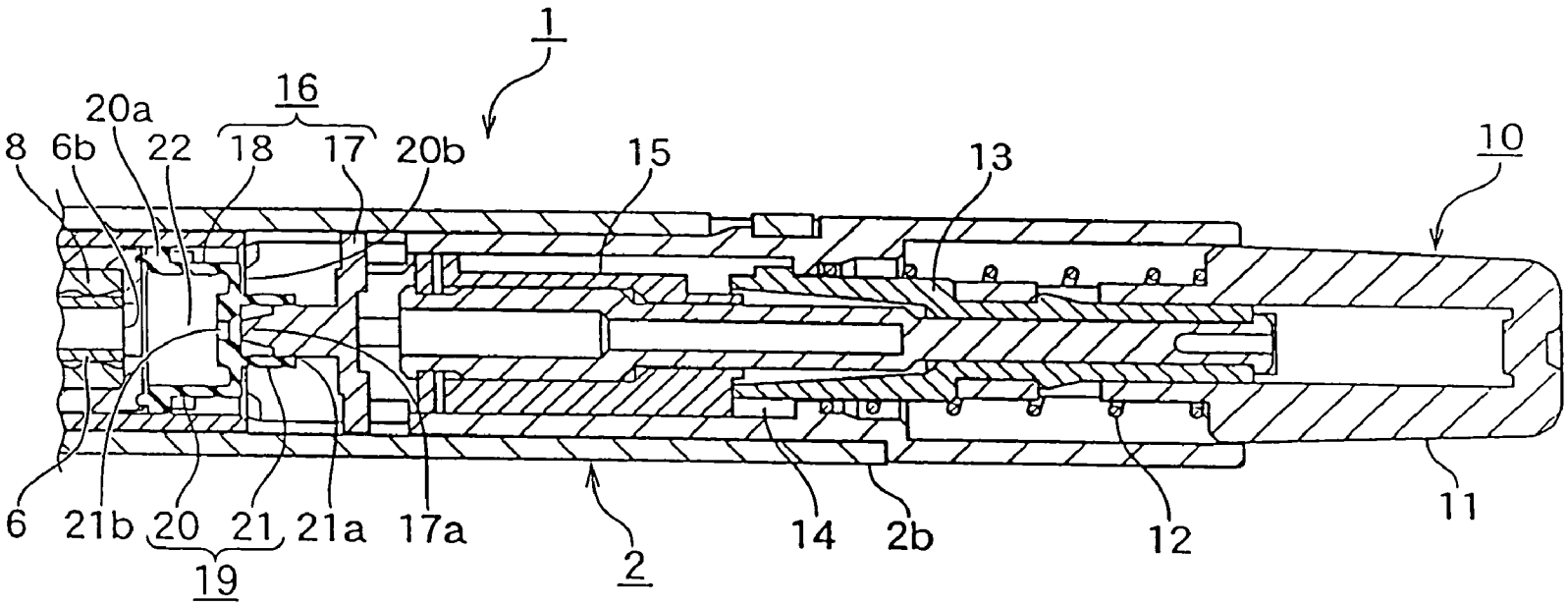
FIG. 2 is an enlarged fragmentary sectional view of a main portion of the pen in the non-pressurized state.

A press pump mechanism 16 is disposed between the rear opening portion 6*b* of the ink containing tube 6 and a front end portion 15*a* of the rotor 15. As shown in FIG. 2, the press pump mechanism 16 includes a pressing member 17 following the drive of the rotor 15, and a pressurizing member 18 disposed between the pressing member 17 and the rear opening portion 6*b* of the ink containing tube 6. A front end portion 17*a* of the pressing member 17 is protruded toward the front to form a cone shape, and the portion in a function as a cap capable of blocking a front aperture 21*b* of a rear cylinder portion 21 in an elastic cylindrical member 19 forming the pressurizing member 18 which will be mentioned later.

The pressurizing member 18 is formed of the elastic cylindrical member 19 made of an elastomer material such as rubber. As shown in the FIG. 3, the elastic cylindrical member 19 includes a large-diameter front cylinder portion 20 of which a rib-shaped front end 20*a* is directly contacted with a slider 8 including the rear opening portion 6*b* of the ink containing tube 6 in an airtight state and communicates with the rear opening portion 6*b* of the ink containing tube 6, and a small-diameter rear cylinder portion 21 which is formed on a rear end of the front cylinder portion 20 through a rear wall 20*b* in a coaxial shape so as to be connected thereto, where the inside of the front cylinder portion 20 forms a pressurizing chamber 22. In the rear cylinder portion 21, from a rear aperture 21*a* to the front aperture 21*b*, the front end portion 17*a* of the pressing member 17 is pushed and inserted so as to communicate with the outside air.

The front end portion 17*a* of the pressing member 17 is pressed into the front aperture 21*b* of the rear cylinder portion 21 so as to tightly stopper the front aperture 21*b*, by the pressing operation accompanied with the frontward movement of the pressing member 17. With such a configuration, it is possible to maintain the airtight state of the pressurizing chamber 22.

Figure 4:
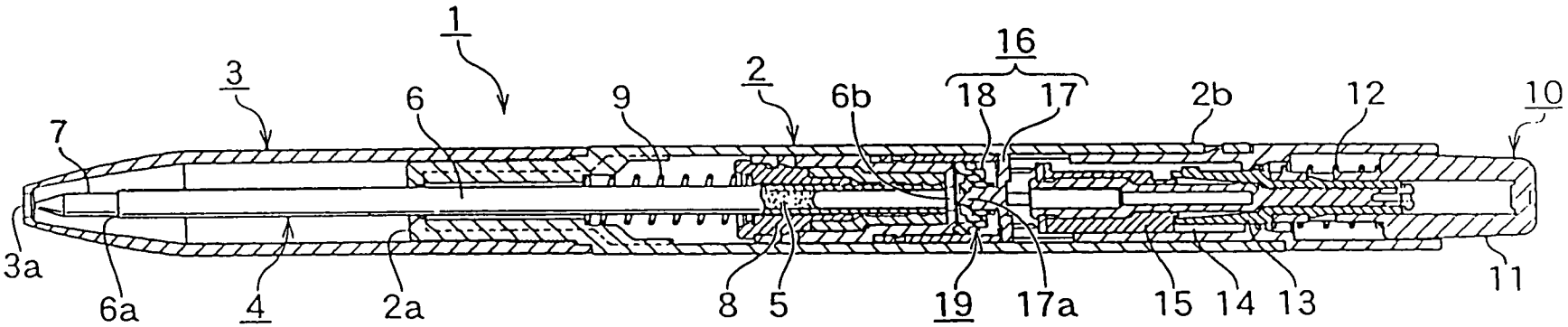
FIG. 4 is a sectional view of the pen in an initial pressurized state.
Figure 5:
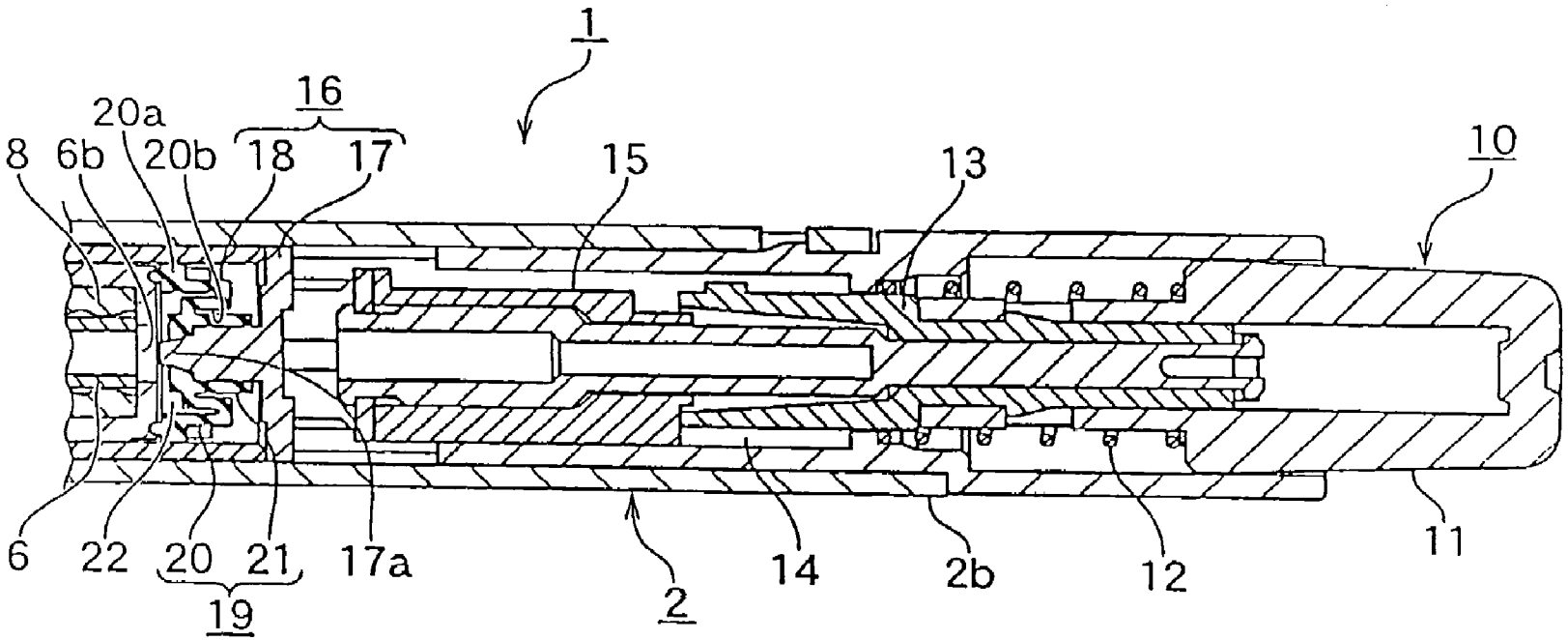
FIG. 5 is an enlarged sectional fragmentary view of the main portion of the pen in the initial pressurized state.
Figure 6:
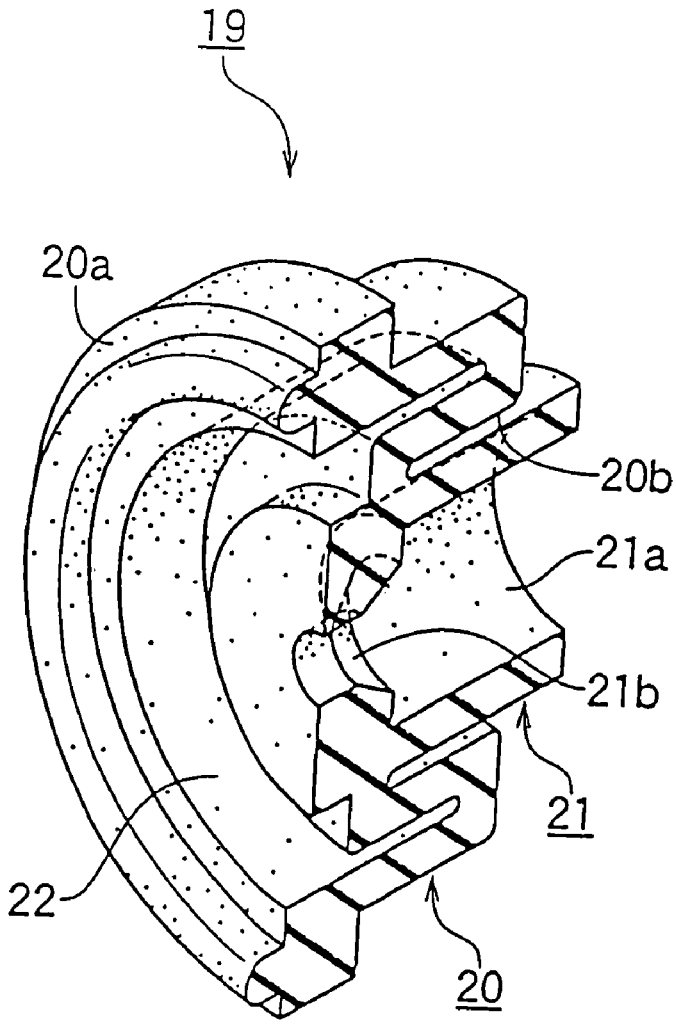
FIG. 6 is an enlarged perspective half-sectioned view of the pressurizing member in a compressive deformation state.

FIG. 4 is a sectional view in an initial pressurized state. Likewise, FIG. 5 is an enlarged sectional view of a main section in the initial pressurized state. FIG. 6 is an enlarged perspective view illustrating the half-section of pressurizing member in a compressive deformation state.

Figure 3:
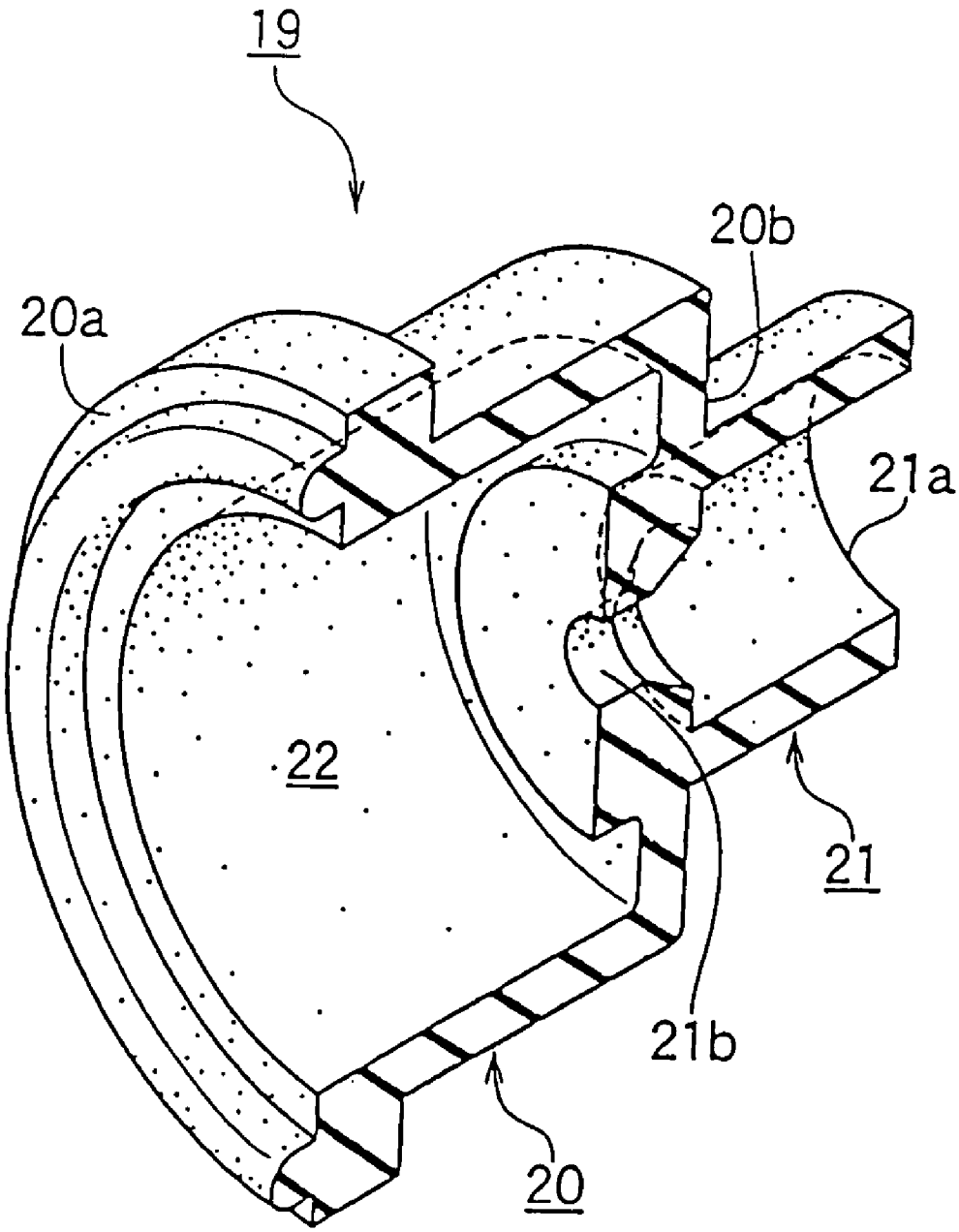
FIG. 3 is an enlarged perspective half-sectioned view of pressurizing member.

In the non-pressurized state illustrated in FIGS. 1 to 3, as shown in FIGS. 4 to 6, when the knock section 11 performs a pressing operation toward the front in a half pressed state against the bias force of the compression spring 12, the knock bar 13 cooperates with the operation and moves frontward, and then the rotor 15 is rotated by a half circle through the cam mechanism portion 14. By the half rotation of the rotor 15, the pressing member 17 moves frontward, and the front end portion 17*a* is pressed into the state pushed into the front aperture 21*b*, whereby the inside of the pressurizing chamber 22 is maintained in the airtight state.

Subsequently, by a further pressing operation of the pressing member 17, the rear cylinder portion 21 bends and deforms the rear end section of the front cylinder portion 20 toward the front of the inside and the rear wall 20*b* toward the rear, while compressing the pressurizing chamber 22 so as to push them into the front cylinder portion 20. In this case, the compressed air is forcibly pumped into the rear opening portion 6*b* of the ink containing tube 6, and thus pressurizing the inside of the rear opening portion 6*b* thereof.

At this time, in the half pressed state of the knock section 11, since the spring force of the compression spring 12 is set to be smaller than the spring force of the compression spring 9 biasing the pen refill unit 4 toward the rear, the pen refill unit 4 is not moved frontward by the pressing force of the knock section 11. For this reason, the pen tip 7 is still contained in the front member 3.

Figure 7:
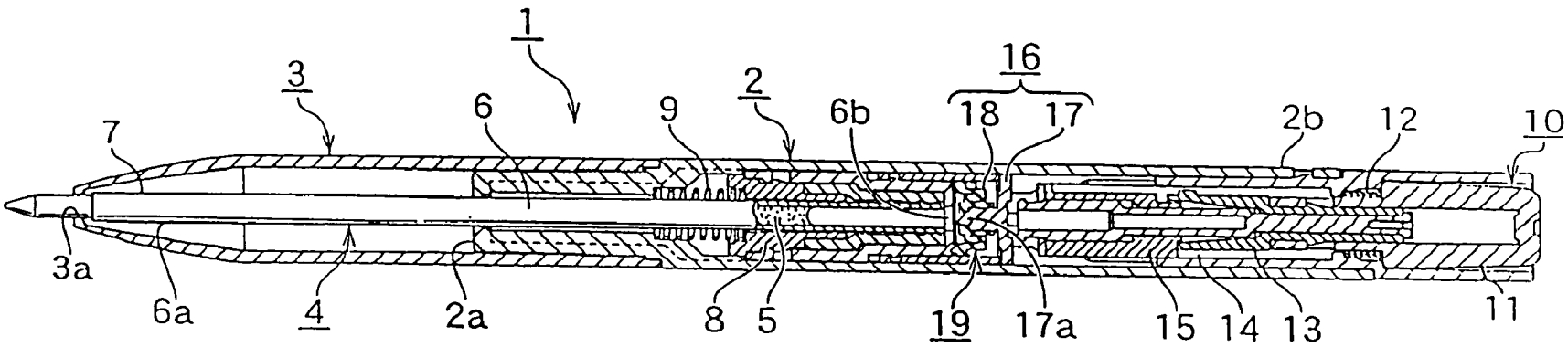
FIG. 7 is a sectional view of the pen in a maximum pressurized state.
Figure 8:
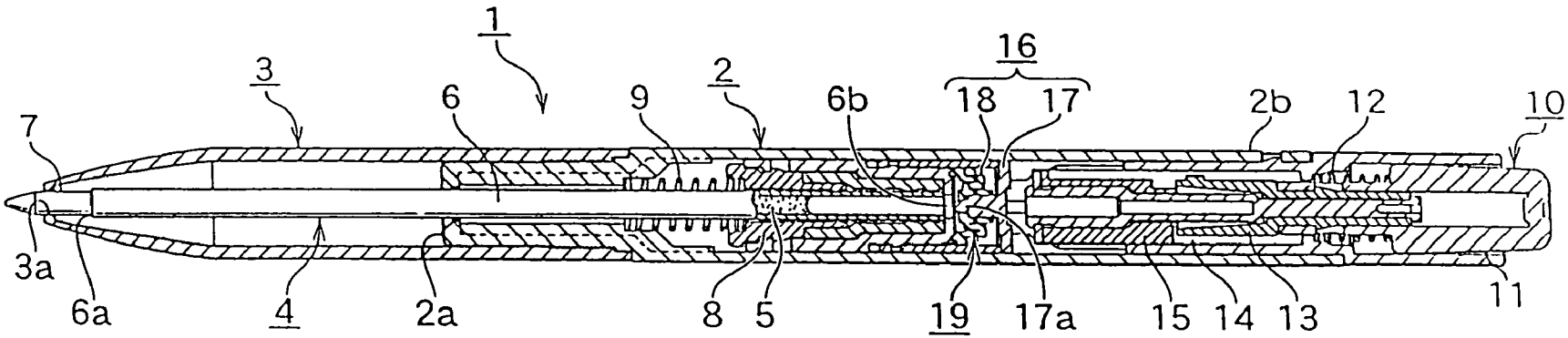
FIG. 8 is a sectional view of the pen in a pressurized state at the time of using the pen.

FIG. 7 is a sectional view in a maximum pressurized state. FIG. 8 is a sectional view in a pressurized state at the time of using the pen.

In the initial pressurizing state illustrated in FIGS. 4 to 6, as shown in FIG. 7, when the knock section 11 pressed frontward by using a force stronger than the spring force of the compression spring 9, the knock bar 13 moves frontward and the rotor 15 is further rotated by the cam mechanism portion 14 in cooperation with the pressing operation. By driving the rotor 15, the pressing member 17 is compressed toward the inside of the pressurizing chamber 22 in the airtight state, the air in the pressurizing chamber 22 is forcibly pumped into the inside of the rear opening portion 6*b* of the ink containing tube 6, and thus the rear opening portion 6*b* of the ink containing tube 6 is pressurized more. In this case, since the pushing force of the knock section 11 is greater than the spring force of the compression spring 9 biasing the pen refill unit 4 to the rear, the pen refill unit 4 moves frontward, and the pen tip 7 is protruded from the inside of the front member 3 in the front end section 2*a* of the barrel 2 toward the outside thereof.

Subsequently, when releasing the pressing operation of the knock section 11, as shown in FIG. 8, only the knock bar 13 is returned rearward to a desired locking position by the bias force of the compression spring 12, the rotor 15 is locked at its driving position at the moment. Therefore, since the pen tip 7 maintains the protruded state and the pressing member 17 is in the state of pressing the elastic cylindrical member 19 of the pressurizing member 18, the pressurizing chamber 22 maintains the pressurizing state.

With such a configuration, since the inside of the ink containing tube 6 is continuously maintained in the pressurizing state at the time of using the pen, and it is thus possible to write even in the state that the pen's front section is inclined upward.

After using the pen, when the knock bar 13 is activated again by pushing the knock section 11 toward the front against the bias force of the compression spring 12, the locking state of the rotor 15 with respect to the cam mechanism portion 14 is released, and the knock bar 13 is returned rearward by the bias force of the compression spring 12. At this time, the rotor 15 moves rearward in company with the pressing member 17, and the rotor 15 is returned to original position illustrated in FIGS. 1 and 2, by the bias force of the compression spring 9. Simultaneously, the elastic cylindrical member 19 of the pressurizing member 18 is returned from the compressed state to the elongated state, and the pressurizing chamber 22 in the ink containing tube 6 and in the front cylinder portion 20 of the elastic cylindrical member 19 becomes the airing state by being separated from the front aperture 21*b* of the rear cylinder portion 21 of the front end portion 17*a* in company with the return toward the rear of the pressing member 17. As a result, the pressurizing state in the ink containing tube 6 is released.

With such a configuration, it is possible to obtain the pressurized pen having excellent feeling of using the pen by allowing an easy knocking operation with small force.

The above description of preferred embodiments has been given by way of example. From the disclosure given, those skilled in the art will not only understand the present invention and the attendant advantages, but will also find apparent various changes and modifications to the structures disclosed. It is sought, therefore, to cover all such changes and modifications as fall within the spirit and scope of the invention, as defined by the appended claims, and equivalents thereof.

BRIEF DESCRIPTION OF REFERENCE NUMERALS

1: KNOCK-TYPE BALL-POINT PEN
2: BARREL
2A: FRONT END SECTION
2B: REAR END SECTION
3: FRONT MEMBER
3A: APERTURE SECTION
4: PEN REFILL UNIT
5: INK (MEDIUM)
6: INK CONTAINING TUBE
6A: FRONT END PORTION
6B: REAR OPENING PORTION
7: PEN TIP
8: HOLDER
9: COMPRESSION SPRING
10: KNOCK MECHANISM
11: KNOCK SECTION
12: COMPRESSION SPRING
13: KNOCK BAR
14: CAM MECHANISM PORTION
15: ROTOR
16: PRESS PUMP MECHANISM
17: PRESSING MEMBER
17A: FRONT END PORTION
18: PRESSURIZING MEMBER
19: ELASTIC CYLINDRICAL MEMBER
20: FRONT CYLINDER PORTION
20A: FRONT END
20B: REAR WALL
21: REAR CYLINDER PORTION
21A: REAR APERTURE
21 B: FRONT APERTURE
22: PRESSURIZING CHAMBER

What is claimed is:

1. A pressurized pen including a pen refill unit loaded in a barrel, a pen tip disposed on a front end portion of a medium containing tube for containing ink and the like in the pen refill unit, a press pump mechanism for pressing an inside of a rear opening portion of the medium containing tube, and a knock mechanism disposed on a rear end section of the barrel, said knock mechanism enables the pen tip to protrude and retreat from the front end section of the barrel, wherein the press pump mechanism includes a pressurizing member having a pressurizing chamber communicating with the inside of the medium containing tube and being disposed on the rear opening portion of the medium containing tube so as to freely expand and contract in an axial direction, and a pressing member which is configured to press the pressurizing member in a pressing direction and which interlocks with a pressing operation of the knock mechanism, and wherein the pressurizing member includes an elastic cylindrical member, said elastic cylindrical member includes a large-diameter front cylinder portion of which a front end in air-tight manner communicates directly with the rear opening portion of the medium containing tube and which forms the pressurizing chamber, and a small-diameter rear cylinder portion which is coaxially connected to a rear end of the front cylinder portion and in which the front end portion of the pressing member is pressed into a rear aperture thereof, whereby the inside of the medium containing tube is pressurized by allowing the pressing member to press the rear cylinder portion into the front cylinder portion and compressing the elastic cylindrical member in the axial direction with the pressing chamber air-tight, and whereby the elastic cylindrical member is decompressed so as to elongate in the axial direction and the inside of the medium containing tube communicates with the outside air, by a pressing and opening operation of the pressing member.

2. The pressurized pen according to claim 1, wherein the pressing member follows a rotor driven through a cam mechanism by the pressing and opening operation of a knock bar in the knock mechanism, and the elastic cylindrical member is compressed to pressurize the inside of the medium containing tube and the pen tip is made to protrude from the front end portion of the barrel by the pressing operation of the knock bar.

3. The pressurized pen according to claim 1, wherein the elastic cylindrical member maintains a compressed state with the pen tip protruding, and the elastic cylindrical member maintains an elongated state where the elastic cylindrical member is capable of communicating with the outside air with the pen tip retreating.

* * * * *